United States Patent [19]

Maret

[11] 4,422,486

[45] Dec. 27, 1983

[54] TRIMMING MACHINE

[75] Inventor: Jean C. Maret, Paris, France

[73] Assignee: Aciers et Outillage Peugeot, Paris, France

[21] Appl. No.: 227,120

[22] Filed: Jan. 21, 1981

[30] Foreign Application Priority Data

Jan. 22, 1980 [FR] France ..... 80 01285

[51] Int. Cl.[3] ..... B27C 1/00

[52] U.S. Cl. ..... 144/117 R; 74/781 R; 144/131; 409/175; 409/180

[58] Field of Search ..... 409/175, 180; 144/117 C, 114 R, 131, 117 R; 125/9; 51/78; 74/781 R, 801

[56] References Cited

U.S. PATENT DOCUMENTS 2,153,856 4/1939 Weydell ..... 74/781 R
2,722,851 11/1955 Steiner ..... 74/781 R
3,143,899 8/1964 York ..... 74/781 R

FOREIGN PATENT DOCUMENTS 55680 12/1936 Denmark ..... 144/114 R
642162 1/1979 U.S.S.R. ..... 144/114 R

*Primary Examiner*—W. D. Bray
*Attorney, Agent, or Firm*—Sughrue, Mion, Zinn, Macpeak and Seas

[57] ABSTRACT

The machine for trimming pieces of wood, such as a surfacing, planing or other machine, comprises a rotary tool having a tool holder provided with projecting axially extending blades and adapted to machine at least one surface of the piece of wood. This tool has, on the input side and output side thereof, two driving rollers for driving the pieces of wood. These rolls have axes parallel to the axis of the tool and are connected to rotate with the latter by a speed reducing mechanism. The mechanism employs a sun and planet train one of the sun wheels of which is mounted directly on the shaft of one of the driving rollers. Another sun wheel is freely rotatable on this shaft and is prevented from rotating relative to the frame of the machine.

5 Claims, 6 Drawing Figures

32
33
34a
36
38
43

2
3
4
5
6
7
7a
11
12
13
14
15
16
17
18
21
23
24
25
26
27
28
29
31
33
34a
34b
35
40
42
42a
44
47
48
PB 23
29
45
46
47

7
12
13
16
19
23
24
26
27
28
29
30
31
32
33
36
37
38
39
40
41
42
42a
43
44
45
47
48

TRIMMING MACHINE

DESCRIPTION

The present invention relates to machines for trimming or truing up pieces of wood, such as surfacing machines and planing machines, comprising a rotary tool having a tool holder provided with projecting axially extending blades and adapted to machine at least one surface of the piece of wood to be machined, there being provided two rollers for driving the pieces of wood and disposed respectively on the input side and output side of the tool, said rollers having axes which are parallel to the axis of the tool and being coupled to rotate with the tool through a planetary gear speed reducing mechanism.

A machine of this type is disclosed in the Swiss Pat. No. 103 483. In this machine, the speed reducing mechanism is mounted on the lower part of the machine and coupled through belt and chain transmissions respectively to the tool and to the driving rollers. Further, the reaction element of the planetary gear train is connected to the frame of the machine through a dog clutch coupling which serves to control the starting up of the machine.

This arrangement of the speed reducing mechanism results in large overall size and requires the use of chains and belts which considerably complicate the device driving the tool and the rollers.

An object of the invention is to simplify this known construction and to provide a strong and compact machine whose planetary gear speed reducing mechanism may be produced more cheaply.

The invention provides a trimming machine of the type defined hereinbefore wherein one of the sun wheels of the sun and planet train is directly mounted on the shaft of one of the driving rollers so as to be rigid with said one driving roller and the other sun wheel is a reaction sun wheel which is freely rotatably mounted on said one driving shaft and prevented from rotating relative to the frame of the machine while being radially slidable in said frame so as to allow the elastically yieldable application of the driving roller on the piece of wood to be machined.

As the speed reducing mechanism is mounted directly on the shaft of one of the driving rollers, it avoids a chain transmission and at the same time permits as easy accommodation of the adaptations of the position of the roller driven by the mechanism to the different thicknesses of the pieces of wood to be machined.

The invention will be described in more detail hereinafter with reference to the accompanying drawing which shows solely one embodiment of the machine.

In the embodiment illustrated in the Figures, the invention is shown applied by way of example to a planing machine. However, it will be observed that the features of the invention are applicable to any trimming or truing up machine other than a planing machine, such as a surfacing machine for example.

Figure 1:
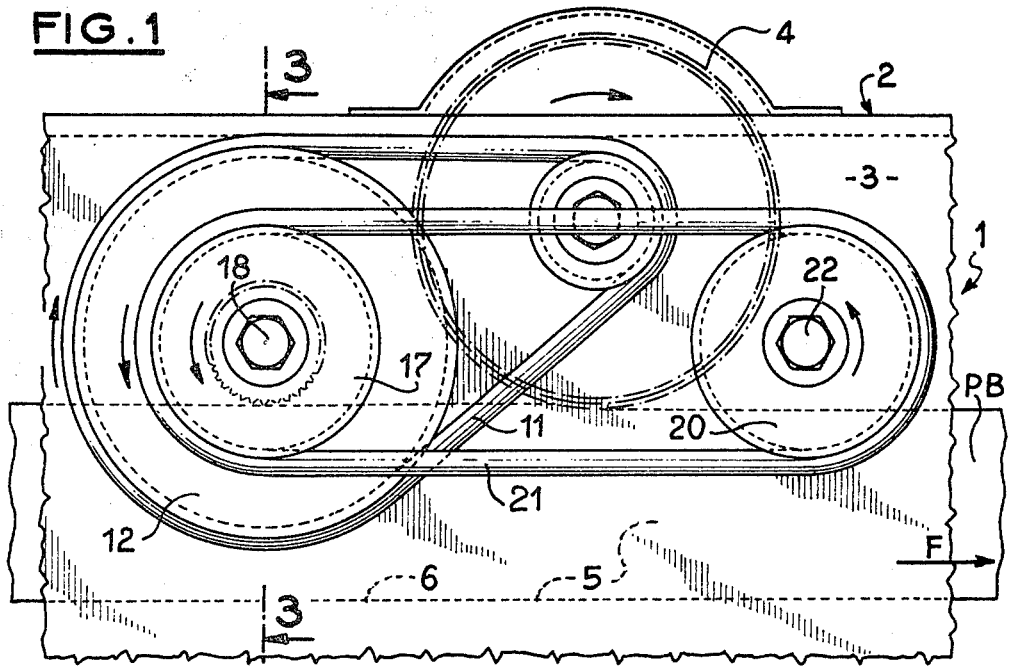
FIG. 1 is a partial elevational view of a planing machine in which the features of the invention have been incorporated.
Figure 2:
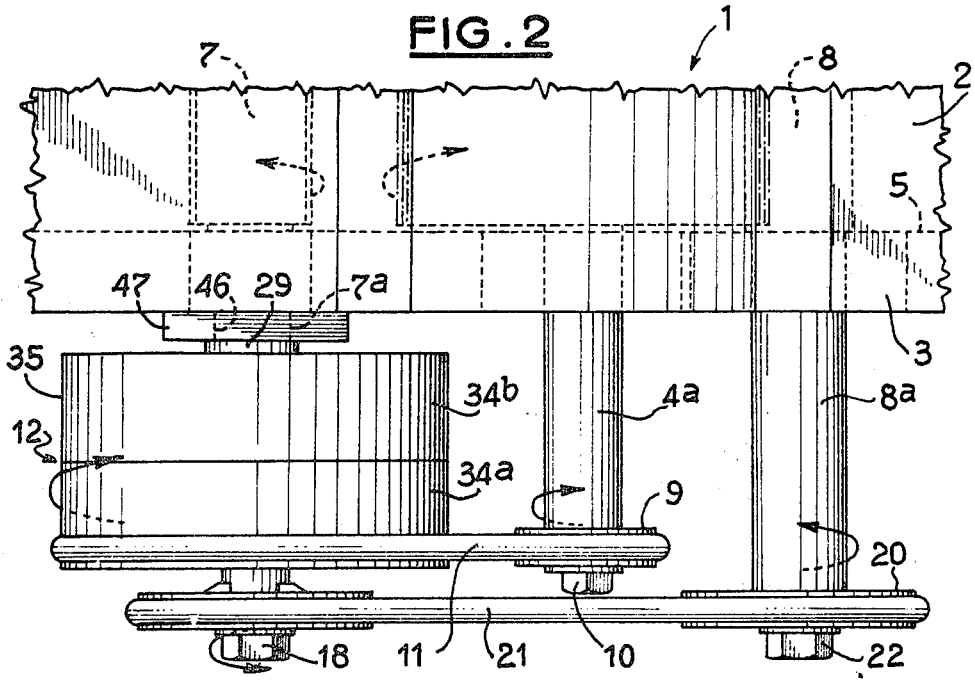
FIG. 2 is a plan view of the part of the planing machine shown in FIG. 1.
Figure 5:
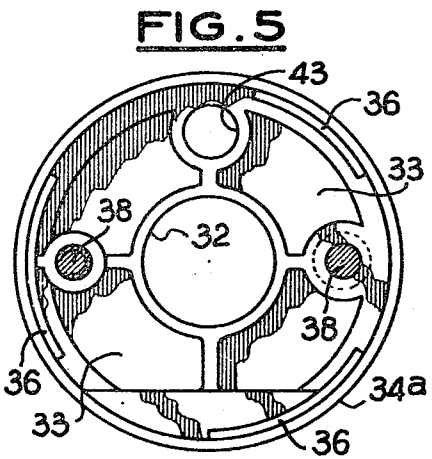
FIG. 5 is a view of one of the halves of the drum forming a planet wheel carrier which is part of the speed reducing mechanism mechanism of the planing machine.

FIGS. 1 and 2 partly show a planing machine 1 which comprises a frame 2 in the sides 3 of which there is rotatably mounted a planing tool 4 in the known manner. This tool is of the type comprising a tool holder provided with projecting axially extending blades (not shown). There is defined in the frame a passageway 5 in which a piece of wood PB to be machined is movable. As shown in particular in FIG. 3, the bottom of this passageway is formed by a support 6 which is adjustable in height.

FIG. 1 shows that the tool 4 projects into the passageway 5, the piece of wood being planed and brought to the required thickness by travelling through the passageway in the direction of arrow F (FIG. 1).

In order to drive along the piece PB, two driving rollers 7 and 8 are provided and placed on each side of the tool 4, their axes being parallel to the axis of the latter. The rollers 7 and 8 project slightly into the passageway 5 and may thus come into contact with the upper surface of the piece PB on the upstream and downstream sides of the working region of the tool 4. In the illustrated embodiment, the roller 7 is placed at the entrance and the roller 8 is placed at the exit of the passageway 5.

The tool 4 is driven in rotation by an electric motor for example (not shown) which rotates at high speed the tool and the shaft 4*a* (FIG. 2) on which the tool is mounted. The driving speed may be, for example, 6000 rpm.

Transmission means drivingly connecting the shaft 4*a* to the rollers 7 and 8 will now be described.

Figure 3:
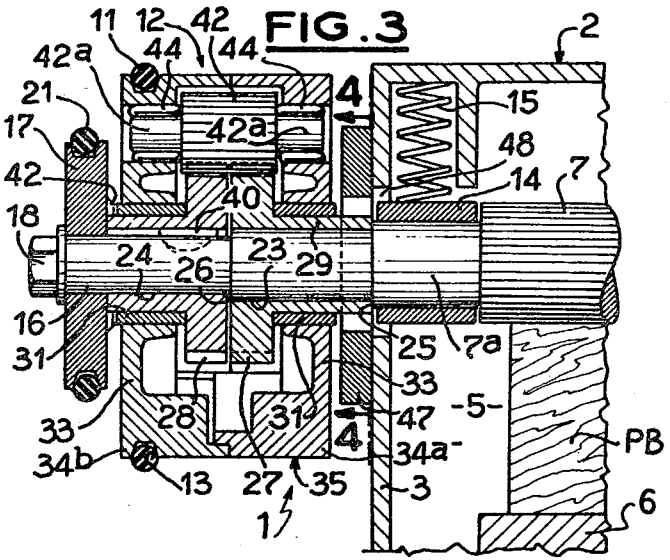
FIG. 3 is a view, partly in section and partly in elevation, of the speed reducing mechanism employed in the planing machine of FIGS. 1 and 2.
Figure 4:
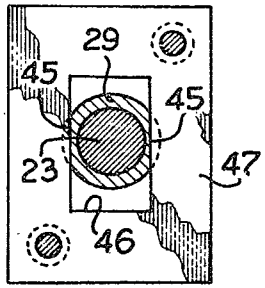
FIG. 4 is a sectional view taken on line 4—4 of FIG. 3.
Figure 6:
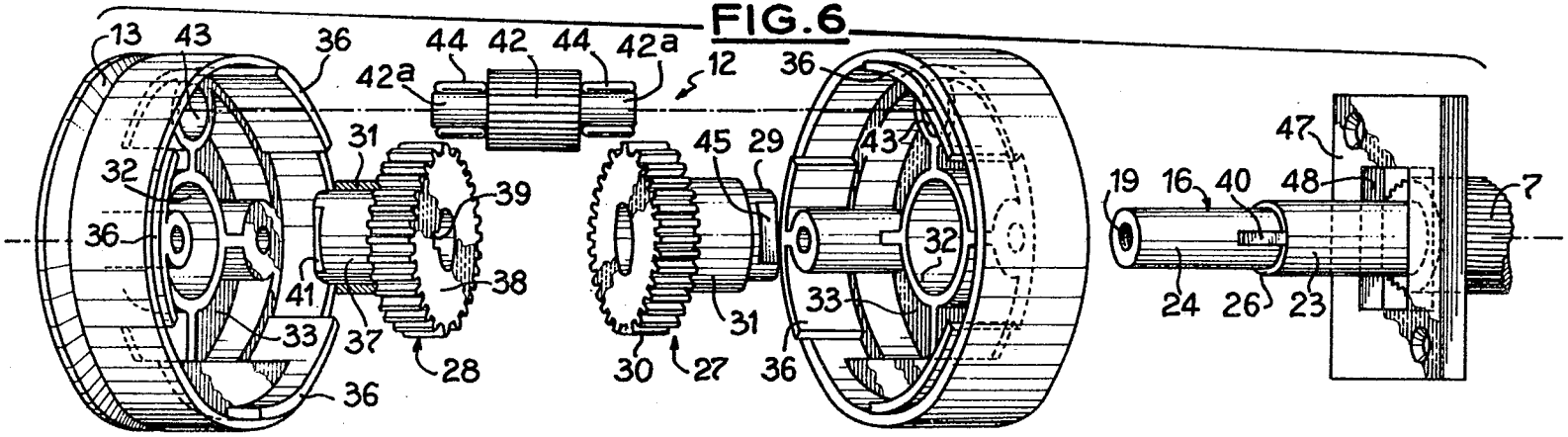
FIG. 6 is an exploded perspective view of the speed reducing mechanism.

The shaft 4*a* carries at the free end thereof a driving pulley 9 which is fixed to this shaft by a bolt 10. Extending around this pulley 9 is a driving belt 11 which is engaged with a speed reducing mechanism 12 which has for this purpose an annular groove 13 (see FIGS. 3 and 6). The rollers 7 and 8, one of which is preferably ribbed, are mounted on shafts 7*a* and 8*a* which are carried in bearings 14 elastically yieldably mounted in the frame 2. In the drawings, only FIG. 3 diagrammatically shows such a bearing 14, and its elastically yieldable mounting is here symbolically represented by a spring 15 which is hooked to the upper part of the frame 2. Consequently, the rollers 7 and 8 are constantly pressed against the piece of wood PB to be machined as it progresses through the passageway 5 and are thus capable of adapting themselves to the thickness of this piece.

Adjacent the speed reducing mechanism 12, the shaft 7*a* has a stepped extension 16 on the free end of which there is provided a pulley 17 which is held in position by a bolt 18 which is engaged in a tapped hole 19 in this extension 16.

Likewise, the shaft 8*a* is extended laterally with respect to the frame 2 and carries, likewise at its free end, a pulley 20 of the same diameter as the pulley 17, a driving belt 21 extending around these pulleys. The pulley 20 is held in position on the shaft 8*a* on which it is keyed by a bolt 22 which is engaged in a tapped hole (not shown) in the shaft 8*a*.

Beyond the bearing 14, the extension 16 of the shaft 7*a* has two bearing surfaces 23 and 24, the latter receiving in particular the pulley 17. Thus, the extension 16 has two annular radially extending shoulders 25 and 26. Mounted on the bearing surface 23 and 24 are a reaction sun wheel 27, prevented from rotating relative to the frame 2, and a rotary sun wheel 28 which forms the output member of the sun and planet train constituting the speed reducing mechanism 12. The sun wheel 27 has a cylindrical sleeve 29 and a gear 30, the sleeve 29 being journalled in a bushing 31. The latter is mounted in a centre aperture 32 of a radial side wall 33 of the half 34*a* of a drum 35 which forms the planet wheel carrier of the speed reducing mechanism 12.

This drum thus comprises two halves 34*a* and 34*b* which are identical apart from the fact that the half 34*b* has the groove 13 in which the belt 11 is engaged for driving this planet wheel carrier. The two halves of the latter are fitted one inside the other by means of lugs 36 which axially project from the confronting edges of the two halves of the drum 35.

The sun wheel 28 has a sleeve 37 and a gear 38, this sun wheel being provided with an axially extending keyway 39 which receives a key 40 for connecting the sun wheel 28 to the shaft 7*a* so that it rotates with the latter.

At the end of the sleeve 37 opposed to the gear 38, the sleeve has two flat faces 41 which cooperate with lugs which prevent the pulley 17 from rotating relative to the sun wheel 28.

The gears 30 and 38 have teeth of identical module but different numbers of teeth for example. Preferably, the gear 30 has 31 teeth whereas the gear 38 has only 30 teeth. Notwithstanding the fact that the sun wheels 27 and 28 are coaxial and are meshed with a single planet wheel 42, this arrangement is possible provided the respective gear teeth mesh together. In fact, the teeth of the sun wheel 27 mesh with the teeth of the planet wheel 42 on a pitch diameter of wheel 27 which is larger than that of the teeth of the sun wheel 28.

The two gears 30 and 38 engage with a single planet wheel or gear 42 which is journalled in the halves 34 *a* and 34*b* of the drum 35 which acts as a planet wheel carrier. For this purpose, these two halves have aligned apertures 43 in which the bearing surfaces 42*a* of the planet wheel 42 are mounted by means of needle bearings 44.

The sleeve 29 of the sun wheel 27 has at the end thereof opposed to the gear 30 two flat faces 45 for preventing rotation of this sun wheel relative to the frame 2. These flat faces 45 cooperate with rectilinear edges of a rectangular aperture 46 formed in a guide plate 47 which is mounted laterally on the frame 2 in front of an aperture 48 which is formed in the lateral wall of this frame and through which extends the shaft 7*a* of the driving roller 7.

The foregoing description shows that the speed reducing mechanism 12 is wholly outside the frame on the shaft 7*a* of the roller 7 and is moreover capble of undergoing vertical movements with this roller in accordance with the variation in the thickness of the piece of wood to be machine, because the sleeve 29 is mounted to be vertically slidable in the plate 47.

The speed reducing ratio of the sun and planet train is comparatively very high and, owing to the presence of this speed reducer, it is possible to achieve the required speed reduction between the tool 4 and the rollers 7 and 8 for a minimum overall size of this speed reducer which never projects above the upper table of the frame 2 of the machine.

The speed reduction ratio may be easily chosen by the difference in the numbers of teeth of the gears 30 and 38.

The sun and planet train also permits arranging that the input and output of the speed reducing mechanism are coaxial, which also reduces the overall size. Further, as the mechanism is housed within an entirely closed drum, which forms an integral part of the speed reducing mechanism, the gear train is shielded from dust and may be easily lubricated once and for all.

The speed reducing mechanism may be constructed from a moulded material, for example from light alloy such as Zamac, or possibly from a plastics material. Advantageously, as shown in the drawing, the two halves of the drum 35 are moulded of identical shape.

The operation of the machine just described will be clear from the foregoing description. Briefly, as the shaft 4*a* is rotated at high speed (eg. 6000 rpm), the tool 4 has a cutting action on the adjacent surfaces of the pieces of wood passing thereover. These pieces of wood are driven through the machine over the support 6 by the rollers 7 and 8 which rotate at much lower speed owing to the inclusion, in the transmission 11, 12, 17, 21 between the pulley 9 rigid with the shaft 4*a* and the shafts 7 and 8, of the sun and planet train speed reducing mechanism 12. Moreover, as the first sun wheel 27 is prevented from rotating relative to the frame 2 by the device 29, 45, 47, and as there is a lower number of teeth on the second sun wheel 28 than on the first sun wheel 27, the effect of the sun and planet train 12 is to rotate the sun wheel 28, and therefore the shaft 7*a* and the roller 7, and the pulley 17 keyed on this shaft 7*a* in the opposite direction to the drum 35 and shaft 4*a*, as shown by the arrows in FIG. 1. Further, the pulleys 17 and 20 are of equal diameter and the shaft 8*a* rotates at the same speed and in the same direction as the shaft 7*a*.

It will be observed that varying thicknesses of the pieces of wood passing through the machine are accommodated by the fact that the roller 4 is vertically slidable relative to the support 6 in opposition to the action of the elastically yieldable means, eg. springs 5.

As can be seen, a particular advantage of the presence of the sun and planet gear speed reducing mechanism results from the reversal of the direction of rotation it provides between its input and output. This special feature enables the speed reducing mechanism to be mounted directly on the shaft of a driving roller which thus constitutes the direct output. In conventional arrangements, there must be provided a special stage in the speed reduction chain (for example gear wheels and belts) to obtain this reversal in the direction of rotation. This feature enables the input of the speed reducing mechanism to be directly connected to the shaft of the tool 4 through an elastically yieldable belt (the belt 11 in the present instance).

Having now described my invention what I claim as new and desire to secure by Letters Patent is:

1. A machine for trimming pieces of wood, such as a surfacing machine, planing machine or other machine, comprising a frame, a support carried by the frame on which support said pieces of wood are supported, a rotary tool adapted to machine at least one surface of said pieces of wood, two driving rollers for driving said pieces of wood in a given direction through the machine along said support, said rollers being provided respectively on an input side and an output side of the tool relative to said given direction and having shafts having axes parallel to the axis of rotation of the tool, and transmission means comprising a sun and planet train speed reducing mechanism connecting the rollers to the tool so that the rollers are rotatable by the tool, a first sun wheel of the sun and planet train being directly mounted on the shaft of a first of the driving rollers and being connected to rotate with said shaft of said first driving roller and a second sun wheel of the sun and planet train being a reaction sun wheel which is freely rotatably mounted on said shaft of said first driving roller, means for preventing the second sun wheel from rotating relative to said frame, means for mounting the shaft of said first roller on the frame so that the shaft is slidable relative to the frame in a plane containing the axis of the shaft of said first roller toward and away from said support, and elastically yieldable means for biasing said first driving roller toward said support.

2. A machine according to claim 1, wherein said means for preventing rotation of the second sun wheel relative to the frame and said means for mounting the shaft of the first roller on the frame comprise means defining a rectilinear guide on the frame, said second sun wheel comprising a coaxial sleeve provided with flat faces which are guided in said guide.

3. A machine according to claim 1 or 2, wherein the sun wheels have an identical tooth module and different numbers of teeth and only a single planet wheel having a single set of gear teeth is engaged with the two sun wheels.

4. A machine according to claim 1 or 2, wherein the shaft of said first driving roller comprises a first pulley which drives, through a belt, a second pulley which has the same diameter as the first pulley and is keyed on the shaft of a second of said driving rollers.

5. A machine according to claim 1 or 2, wherein the sun and planet train comprises an outer drum in two parts and the two parts of the drum are moulded and identical to each other.

* * * * *